US012053112B1

(12) United States Patent
Taylor et al.

(10) Patent No.: US 12,053,112 B1
(45) Date of Patent: Aug. 6, 2024

(54) PILLOW WITH INTERNAL RF SHIELDING STORAGE COMPARTMENT

(71) Applicants: Jade Taylor, Plantation, FL (US); Jeri Taylor, Plantation, FL (US)

(72) Inventors: Jade Taylor, Plantation, FL (US); Jeri Taylor, Plantation, FL (US)

( * ) Notice: Subject to any disclaimer, the term of this patent is extended or adjusted under 35 U.S.C. 154(b) by 0 days.

(21) Appl. No.: 18/368,828

(22) Filed: Sep. 15, 2023

(51) Int. Cl.
*A47G 9/10* (2006.01)
*A47C 31/00* (2006.01)

(52) U.S. Cl.
CPC ..... *A47G 9/1045* (2013.01); *A47C 31/004* (2013.01); *A47G 2009/1018* (2013.01); *A47G 2400/12* (2013.01)

(58) Field of Classification Search
CPC ..... A47G 9/10; A47G 2009/1018; A47C 31/004; A45F 2200/0516; A45C 2011/002; G06K 19/07327
See application file for complete search history.

(56) References Cited

U.S. PATENT DOCUMENTS 732,864 A * 7/1903 Jones ..... A47G 9/10 5/491
2,293,530 A * 8/1942 Beehler ..... B60R 7/043 5/639
2,822,554 A * 2/1958 Wenzelberger ..... A47C 27/081 5/644
3,863,283 A * 2/1975 Mohr ..... A47G 9/1045 5/639
4,298,103 A * 11/1981 De Fries ..... A45C 9/00 383/110
4,868,033 A * 9/1989 Nakano ..... B32B 15/20 428/209
4,959,880 A * 10/1990 Tesch ..... A47G 9/10 5/636
5,918,332 A * 7/1999 Dees ..... A47G 9/1045 5/639
6,041,458 A * 3/2000 Vickers ..... A47G 9/10 5/636
6,088,856 A * 7/2000 Boyer ..... A47G 9/10 5/639

(Continued)

FOREIGN PATENT DOCUMENTS

AU 2014306313 A1 * 3/2016 ..... A41D 31/32
BE 1018180 A3 * 6/2010 ..... A47C 31/004

(Continued)

*Primary Examiner* — Eric J Kurilla
(74) *Attorney, Agent, or Firm* — Mark C. Johnson; Johnson Dalal

(57) ABSTRACT

A pillow with internal shielding storage compartment including a pillow body defining an internal cavity, with an outer cushion layer of a deformably resilient material flanking the internal cavity, having an outer surface continuously spanning around the pillow body, and having a pillow length separating the left and right ends, wherein the pillow body also includes an inner layer enclosing the internal cavity, of a material more rigid than the deformably resilient material of the outer cushion layer and substantially spanning the pillow length, of a thickness less than 25 mm, and configured to attenuate radio frequencies ranging up to 3 Ghz. The pillow body also defines an opening providing access to the internal cavity and that can be selectively opened and closed.

16 Claims, 9 Drawing Sheets

(56) References Cited

U.S. PATENT DOCUMENTS

| | | | | |
|---|---|---|---|---|
| 7,188,896 | B2 * | 3/2007 | Embach | B60N 2/879 297/391 |
| 8,127,382 | B1 * | 3/2012 | Plascencia | A47G 9/1045 5/639 |
| 9,101,234 | B2 * | 8/2015 | Berg | B68G 7/12 |
| D896,546 | S * | 9/2020 | Lowder | D6/601 |
| 2004/0022046 | A1 * | 2/2004 | Leerkamp | H05K 9/003 361/816 |
| 2007/0261414 | A1 * | 11/2007 | Polder | A61F 7/007 62/3.5 |
| 2011/0010862 | A1 * | 1/2011 | Mitchell | A47G 9/0253 53/461 |
| 2012/0114270 | A1 * | 5/2012 | Roberts | H05K 9/0043 29/428 |
| 2014/0373792 | A1 * | 12/2014 | Gallo | A01K 1/0353 119/28.5 |
| 2015/0157148 | A1 * | 6/2015 | Collins | A47G 9/1045 5/639 |
| 2016/0119009 | A1 * | 4/2016 | Peterson | H04B 1/385 455/575.6 |
| 2016/0347509 | A1 * | 12/2016 | Callan | A45C 11/00 |
| 2017/0042350 | A1 * | 2/2017 | Mittal | A47G 9/10 |
| 2018/0014667 | A1 * | 1/2018 | Ibrahim | A47G 9/10 |
| 2018/0035832 | A1 * | 2/2018 | Ureten | A61M 21/02 |
| 2018/0140101 | A1 * | 5/2018 | Davis | A47C 7/746 |
| 2018/0242750 | A1 * | 8/2018 | Wilson | A47C 7/383 |
| 2019/0082867 | A1 * | 3/2019 | Huang | A47G 9/1036 |
| 2019/0290033 | A1 * | 9/2019 | Lonstein | A47G 9/10 |
| 2019/0313718 | A1 * | 10/2019 | Voy | A47G 9/0238 |
| 2021/0196015 | A1 * | 7/2021 | Krauss | A45C 3/06 |

FOREIGN PATENT DOCUMENTS

| | | | | | |
|---|---|---|---|---|---|
| CN | 201664001 | U | * | 12/2010 | |
| CN | 107411459 | A | * | 12/2017 | |
| DE | 202004017214 | U1 | * | 2/2005 | A47C 31/004 |
| DE | 202015106301 | U1 | * | 1/2016 | A45C 11/00 |
| FR | 2957768 | A3 | * | 9/2011 | A47C 27/00 |
| JP | 4286907 | B1 | * | 7/2009 | A47G 9/00 |
| KR | 20070000953 | U | * | 8/2007 | |
| KR | 200466100 | Y1 | * | 4/2013 | |
| KR | 20180075846 | A | * | 7/2018 | |
| KR | 20230061301 | A | * | 5/2023 | |
| WO | WO-2010035360 | A1 | * | 4/2010 | A47G 9/10 |
| WO | WO-2012074425 | A1 | * | 6/2012 | A47G 9/10 |

* cited by examiner 7-7

PILLOW WITH INTERNAL RF SHIELDING STORAGE COMPARTMENT

FIELD OF THE INVENTION

The present invention relates generally to sleep accessories and, more particularly, pillows having an internal storage compartment and pillows with internal RF shielding storage compartment.

BACKGROUND OF THE INVENTION

Lounging or laying in bed is a comfortable experience that is often frustrated by the inability to readily locate and access key items like a user's cell phone or television remote control. Bed sheets, comforters, quilts, blankets, sleeping pillows, throw pillows, plushed toys, and other bedding accessories that are typically found on a bed make it easy for compact items like a cell phone or remote to get lost, resulting in the needless expenditure of time and the hassle and inconvenience of searching for such items. If a user places such items on a nearby nightstand or bedside table, however, the items are no longer within arm's reach and require the user to stand up, sit up, or, at a minimum, move and stretch from their existing position to grab the item. Reaching for these items are inconvenient for most users, particularly where the user is forced to do this on a regular basis. Users who have limited physical mobility, are ill, or that are on bedrest may also have even greater difficulty in either reaching items resting on a nearby nightstand or looking for the items if and when they get lost among the bed sheets, comforter, pillows, etc.

There are many known padded storage containers, but very few are comfortable enough for users to rest on. Those known storage containers that could provide enough comfort to users are not structurally configured to safely house the items within pillow or to enable users to effectively grasp items stored within the container. Furthermore, those known pillows also fail to shield users from radio frequencies (RF) that many users find to be harmful or otherwise desire to be shielded from.

Therefore, a need exists to overcome the problems with the prior art as discussed above.

SUMMARY OF THE INVENTION

The invention provides a pillow with internal storage compartment that overcomes the hereinafore-mentioned disadvantages of the heretofore-known devices and methods of this general type and that makes it easier for a user to readily locate and grab key items such as a cellphone or television remote.

With the foregoing and other objects in view, there is provided, in accordance with the invention, a pillow with internal RF shielding storage compartment having a pillow body that defines an internal cavity, that includes an outer cushion layer of a deformably resilient material flanking the internal cavity, having a left end, having a right end opposing the left end, having an upper end, having a lower end opposing the upper end, having an outer surface continuously spanning around the pillow body, and having a pillow length separating the left and right ends, that includes an inner layer enclosing the internal cavity, of a material more rigid than the deformably resilient material of the outer cushion layer and substantially spanning the pillow length, of a thickness less than 25 mm, and configured to attenuate radio frequencies ranging up to 3 Ghz, and that defines an opening disposed proximal to the left end that is spatially coupled to the internal cavity, wherein the opening is operably configured to have a selectively opened position and a selectively closed position with at least one fastener coupled to the pillow body In accordance with a further feature of the present invention, the outer surface of the outer cushion layer is of a fabric material and/or a foam material.

In accordance with another feature of the present invention, the outer cushion layer and the inner layer are adhesively coupled to one another.

In accordance with yet another feature of the present invention, the inner layer is of metallic material and/or is coated with a metallic material and is made of at least one of a polymeric material and/or paper-based material.

In accordance with another feature, the inner layer also includes a static unflexed position with the internal cavity of a diameter ranging from 50-152 mm and a dynamically flexed position with the internal cavity of a diameter approximately 50% less than the diameter of the internal cavity in the static unflexed position.

In accordance with an additional feature of the present invention, the inner layer spans at least 75% of the pillow length and is encapsulated by the outer cushion layer when the opening is in the selectively closed position.

In accordance with another feature, the pillow body also includes two zipper tracks each flanking the opening and with the at least one fastener coupled to one of the two zipper tracks, wherein the two zipper tracks and the at least one fastener are operably configured to place the opening in the selectively closed position.

In accordance with yet another feature, the pillow body also includes a clip coupled to the pillow body and with two clip members operably configured to selectively open and close, thereby retaining a cable thereto.

In accordance with an additional feature of the present invention, the inner layer is of a substantially rigid and flexible material and the inner layer thickness unitarily spans the pillow length.

Also in accordance with the present invention, a pillow with internal RF shielding storage compartment is disclosed that includes a pillow body defining an internal cavity, with an outer cushion layer of a deformably resilient material flanking the internal cavity, having a left end, having a right end opposing the left end, having an upper end, having a lower end opposing the upper end, having an outer surface continuously spanning around the pillow body, and having a pillow length separating the left and right ends, with an inner layer enclosing the internal cavity, of a substantially rigid and flexible material that is more rigid than the deformably resilient material of the outer cushion layer and that substantially spans the pillow length, and of a slender thickness substantially spanning the pillow body, and defining an opening disposed proximal to the left end that is spatially coupled to the internal cavity, wherein the opening is operably configured to have a selectively opened position and a selectively closed position with at least one fastener coupled to the pillow body.

In accordance with another feature of the present invention, the inner layer is of a thickness less than 25 mm.

Although the invention is illustrated and described herein as embodied in a pillow assembly with internal storage compartment, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the pillow, or to-and-from the left and right ends of the pillow body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
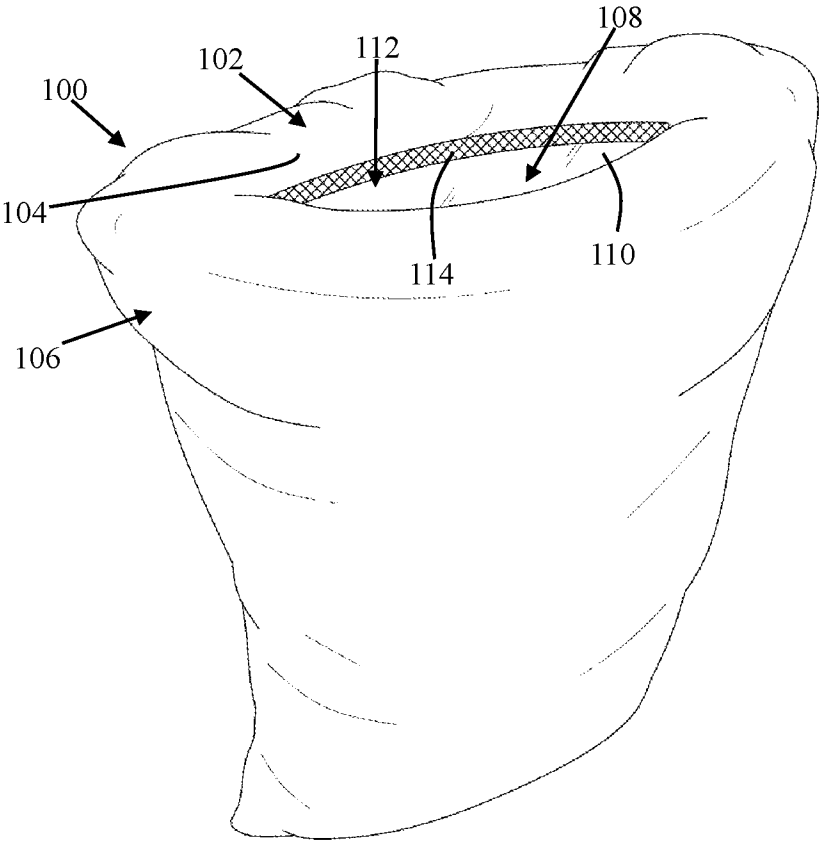
FIG. 1 depicts a perspective side view of a pillow with internal RF shielding storage compartment in an open configuration, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient pillow assembly with internal storage compartment designed to prevent a user from inadvertently losing key items among the bed sheets, comforters, quilts, blankets, sleeping pillows, throw pillows, plushed toys, and other bedding accessories that are typically found on a bed and to easily locate and reach such key items without expending valuable time and physical energy looking for the same. Embodiments of the invention provide an assembly that is particularly useful to users with limited mobility or who are otherwise physically constrained and have difficulty reaching, standing, sitting up, or moving. Beneficially, the present invention combines several functionalities and features into one compact assembly that doubles as a pillow. Specifically, the assembly serves as a pillow that a user may lay or rest on while containing an internal compartment configured to house small or medium-sized items like television remotes, cellphones, reading glasses, books, etc. The size and shape of the assembly may also vary to accommodate different needs and preferences, e.g., an assembly that is longer in length to serve as a body pillow. The invention also beneficially shields the user from certain radio frequencies that many users find problematic.

Referring now to FIG. 1, one embodiment of the present invention is shown in a perspective side view. FIG. 1 shows several advantageous features of the present invention, but, as will be described below, the invention can be provided in several shapes, sizes, combinations of features and components, and varying numbers and functions of the components. The first example of pillow with internal RF shielding storage compartment 100 (referred to hereinafter as "assembly 100" for brevity), as shown in FIG. 1, includes a pillow body 102 that may be shaped and sized in various shapes and dimensions. In preferred embodiments, the pillow body 102 is rectangular and is formed with width×length dimension of approximately 20 in.×26 in. (50 cm×66 cm), 20 in.×30 in. (50 cm×76 cm), 20 in.×36 in. (50 cm×91 cm), or 20 in.×54 in. (50 cm×137 cm).

Figure 3:
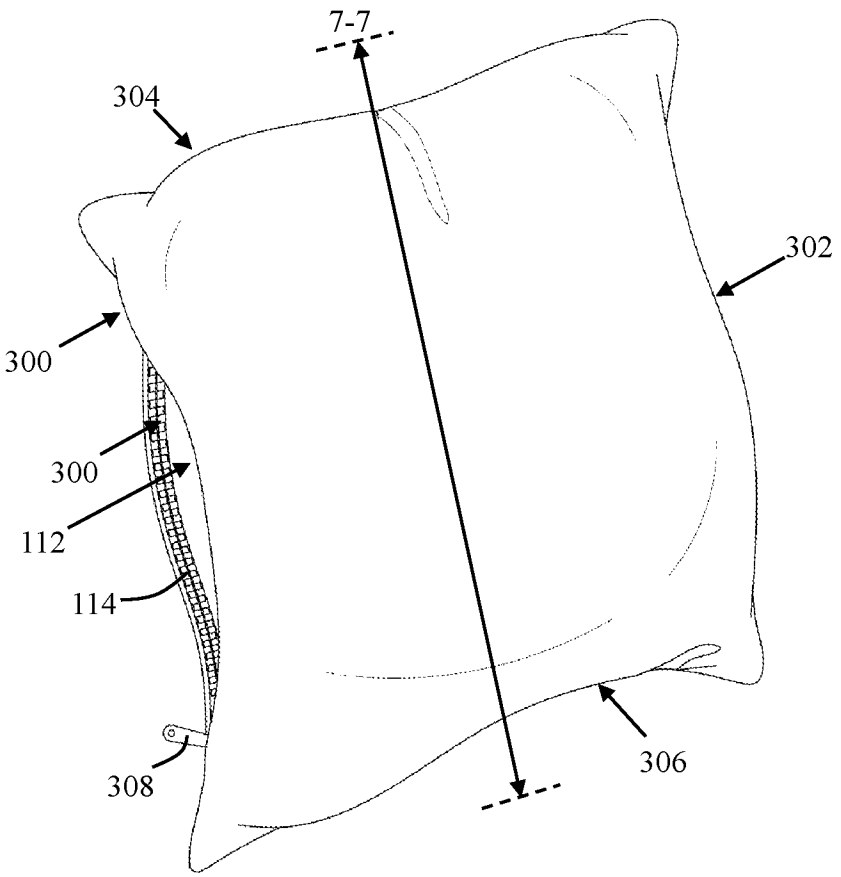
FIG. 3 depicts a perspective front view of the pillow assembly with internal storage compartment according to FIG. 1, in accordance with the present invention.

With reference to FIG. 1 and FIG. 3, the pillow body 102 can be seen defining an internal cavity 108 that may also be of a shape corresponding to the outer shape of the pillow body 102 but is preferably smaller in length than the overall length of the pillow body 102. Specifically, the pillow body 102 includes an outer cushion layer 104 of a deformably resilient material that flanks the internal cavity 108 on opposing sides, directly or indirectly, and includes a left end 300, a right end 302 opposing the left end 300, an upper end 304, a lower end 306 opposing the upper end 304, an outer surface 106 continuously spanning around the pillow body 102, and a pillow length 800 separating the left and right ends 300, 302. The pillow length 800 corresponds to the length of the pillow body 102. In one embodiment, the outer cushion layer 104 is made of a deformably resilient material, e.g., feather, polyester fill, organic cotton, memory foam, latex. Said differently, the outer surface 106 of the outer cushion layer 104 may be made completely or partially of a fabric material and, in some embodiments, may also include a separate layer or encasing for the deformably resilient material. In one embodiment, the outer cushion layer 102 is of a foam material, wherein said material advantageously provides the most efficient tradeoff between comfort and rigidity needed to protect the contents within the internal cavity 108.

The pillow body 102 also includes an inner layer 110 enclosing the internal cavity 108 and, in some embodiments, completely encapsulating the internal cavity 108. The inner layer 110 is preferably of a substantially rigid and flexible material that enables the internal cavity 108 to deform, but not completely lay flat, under normal compression forces caused by a user's head or body weight, e.g., up to 10 lbs. Said another way, the inner layer 110 is preferably of a material more rigid than the deformably resilient material of the outer cushion layer 104 and, because of its thickness and material characteristics, allows it to bend, but not elastically deform. In one embodiment, the inner layer 110 substantially spans (i.e., greater than 70%) the pillow length 800 and may otherwise completely encapsulate the internal cavity 108. In one embodiment, based on the testing, the inner layer 110 should span at least 75% of the pillow length 800. The inner layer 110 is preferably of a thickness less than 25 mm so, as discussed above, the inner layer can flex when the user's applies compressive forces thereon. Also in preferred embodiments, the thickness of the inner layer 110 unitarily spans the pillow length 800 (whether substantially or completely).

Figure 4:
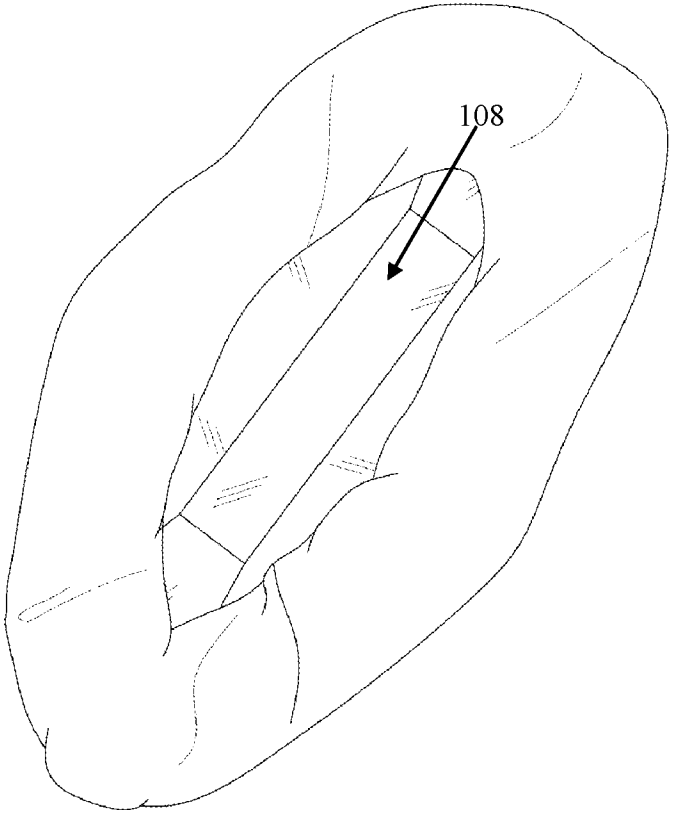
FIG. 4 depicts a perspective top view of the pillow assembly with internal storage compartment, in accordance with the present invention.
Figure 5:
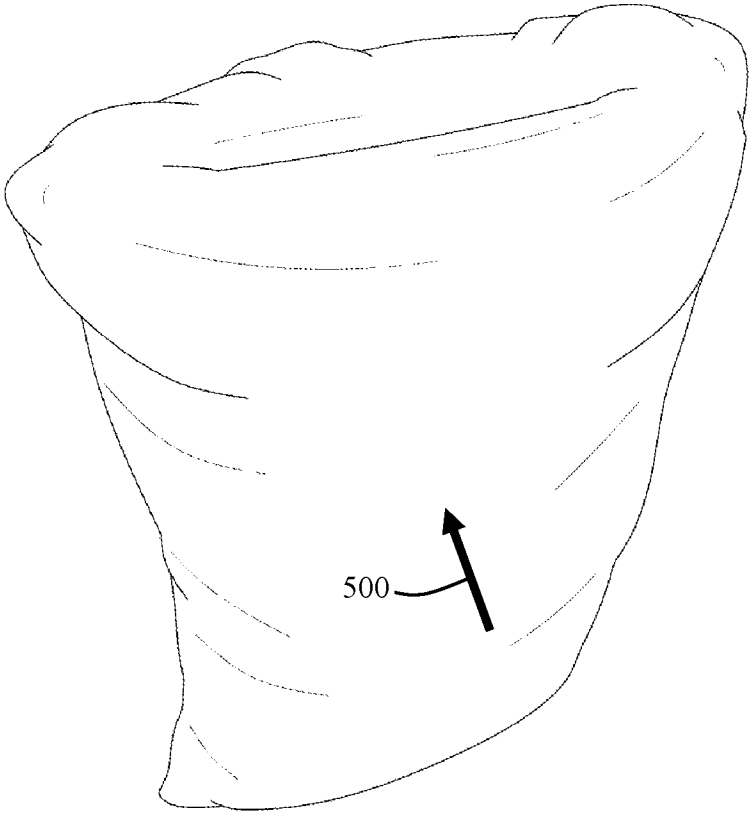
FIG. 5 depicts a perspective side view of the pillow assembly with internal storage compartment in a closed configuration, in accordance with the present invention.
Figure 6:
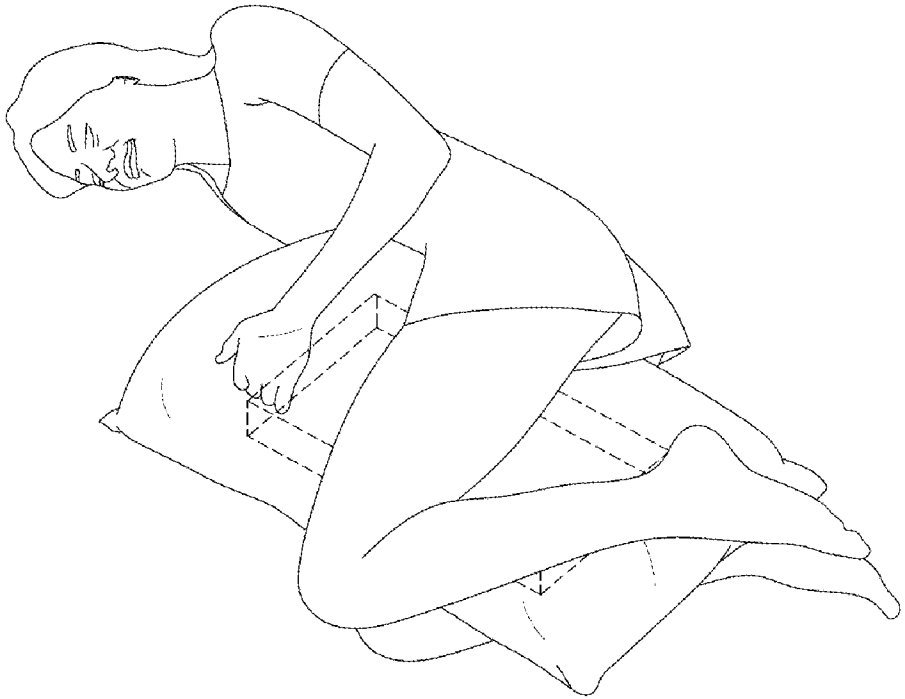
FIG. 6 depicts a perspective top view of the pillow assembly with internal storage compartment in use, in accordance with the present invention.
Figure 7:
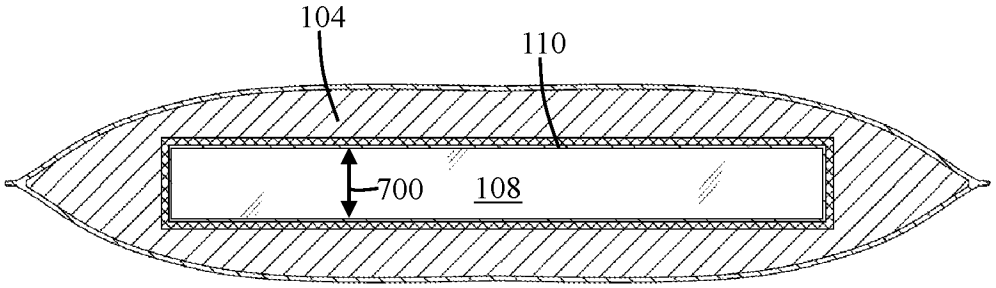
FIG. 7 depicts a cross-sectional view of the pillow assembly with internal storage compartment, in accordance with the present invention.

The outer cushion layer 104 and the inner layer 110 are, in one embodiment, adhesively coupled to one another. In other embodiments, the layers 104, 110 may be coupled to one another with gravity, with fastener(s), or by other means. In one embodiment, the inner layer 110 is of metallic material or a polymeric material or paper-based material. In one embodiment, the inner layer 110 is of a material or otherwise has material characteristic, wherein it has a static unflexed position (e.g., like FIG. 4) with the internal cavity 108 of a diameter (e.g., 700, see FIG. 7) ranging from 50-152 mm and a dynamically flexed position (e.g., like FIG. 5) with the internal cavity 108 of a diameter approximately 50% less than the diameter of the internal cavity 108 in the static unflexed position. With reference to FIG. 5, the term "dynamically flexed position" means a position caused by an external force (e.g., like the force 500 caused by a user's head) that causes the inner layer 110 to flex, wherein the static unflexed position is the inherent position or orientation of the inner layer 110 without any external force applied on the outer surface of the inner layer 110 (directly or indirectly)—with the exception of the force applied by the outer cushion layer 104 or covering.

Figure 9:
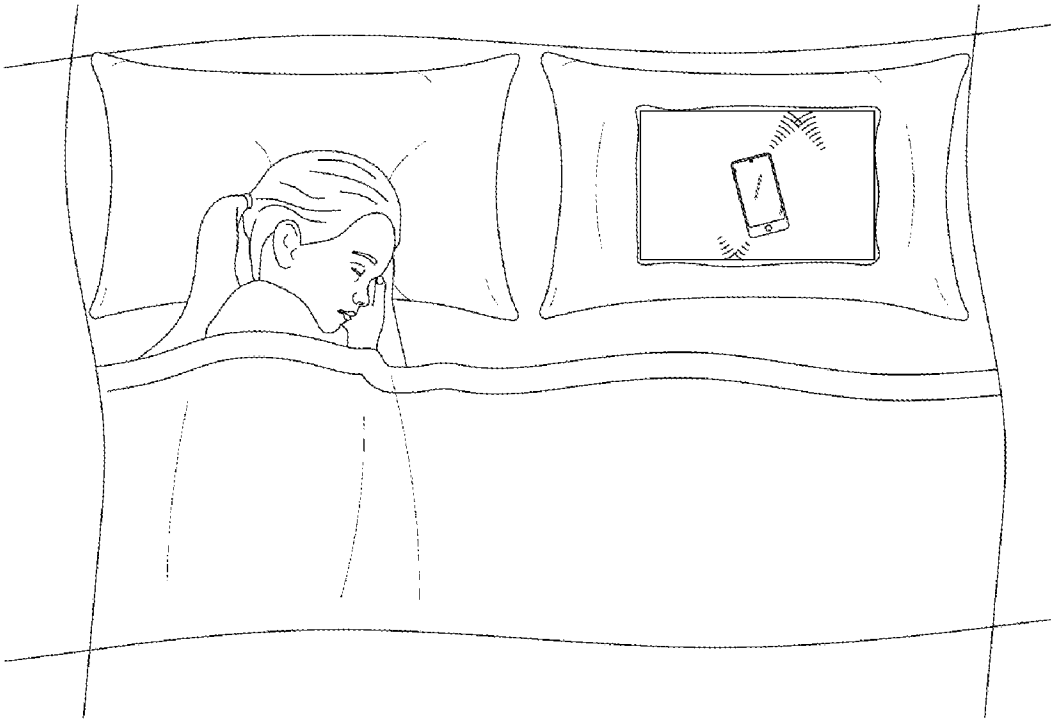
FIG. 9 is a perspective view of the pillow assembly with internal storage compartment in use, in accordance with the present invention.

Some exemplary materials for the inner layer 110 include a copper, nickel, silver, aluminum, high-density polyethylene (HDPE), low-density polyethylene (LDPE), polypropylene (PP), nylon (PA), or other polymeric or metallic material having a thickness of approximately 5-38 mm (e.g., commonly referred to as thin sheet) that may be uniform in thickness spanning the length of the inner layer 110. The inner layer 110 material may also be made with a wood, rag, textile, or grass material having a thickness of approximately 5-50 mm. Beneficially, the inner layer 110 is also configured to beneficially attenuate radio frequencies ranging up to 3 Ghz. Said another way, the inner layer 110 inhibits or blocks the electromagnetic field (EMF) emitted from a device within the internal cavity 108 by, in preferred embodiments, EMF barriers or liners made with conductive or magnetic materials, e.g., copper, nickel, bronze, aluminum, gold, brass, etc. In some embodiments, the inner surface of the inner layer 110 is coated with a metallic material, e.g., metallic ink like copper or similar material, especially when the inner layer 110 is formed from a polymeric material or paper-based material. The EMF shielding serves to minimize electromagnetic interference and emissions from the internal cavity 108. In particular, thin sheet aluminum, which has a low density, allows EMF shielding with the strength as thicker sheets made from other metals. As such, the inner layer 110 can inhibit or block a variety of RF bands (exemplified in FIG. 9), including the PCS band and AWS band, which many users desire.

The opening 112 defined by the pillow body 102 may be disposed proximally (e.g., at or near—within 10% of the overall length of the pillow body 102) to the left end 300 of the pillow body 102. The opening 112 is also spatially coupled to the internal cavity 108 and is operably configured to have a selectively opened position (e.g., providing complete edge to edge access into the cavity) and a selectively closed position (e.g., that is completely sealed) with at least one fastener 116 coupled to the pillow body 102. This feature enables the user to selectively access and seal the internal cavity 108 to place or remove personal items, including a user's electronic device, namely a cellular phone or remote. In preferred embodiments, the inner layer 110 is encapsulated by the outer cushion layer 104 when the opening 112 is in the selectively closed position, thereby preventing the personal item(s) within the internal cavity 108 from becoming inadvertently dislodged or removed.

In one embodiment, the fastener(s) on the pillow body 102 used to selectively open and close the opening 112 include two zipper tracks 114 each flanking the opening 112 and at least one fastener 308 coupled to one of the two zipper tracks 114, wherein the two zipper tracks 114 and the at least one fastener 308 are operably configured to place the opening 112 in the selectively closed position. The zipper tracks 114 and fastener 308 enable the opening 112 to be completely closed or sealed within the internal cavity 108. In other embodiments, the pillow body 102 may include magnets (shown in FIG. 2) or snaps that close the opening, but not completely (which is beneficial when desiring to extend a charging cable out of the pillow body 102).

Figure 2:
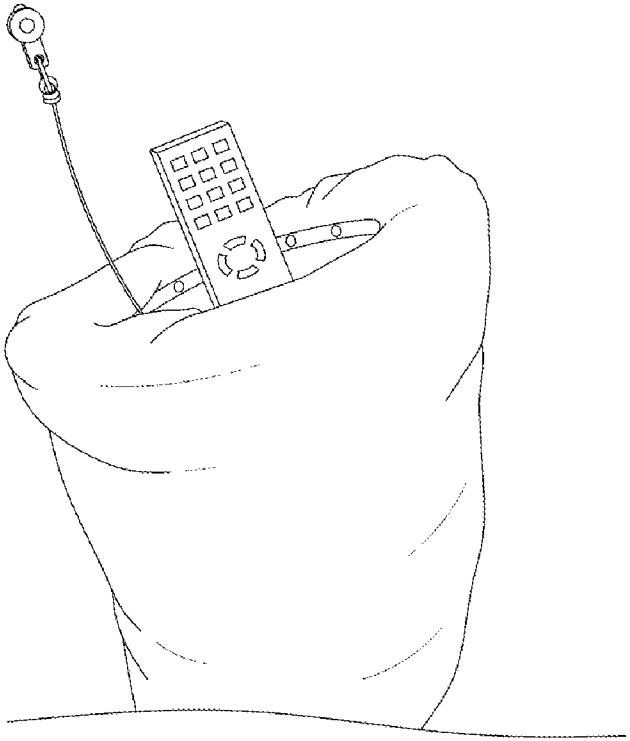
FIG. 2 depicts a perspective and partial side view of a pillow with internal RF shielding storage compartment with a remote control protruding therefrom, in accordance with the present invention.
Figure 8:
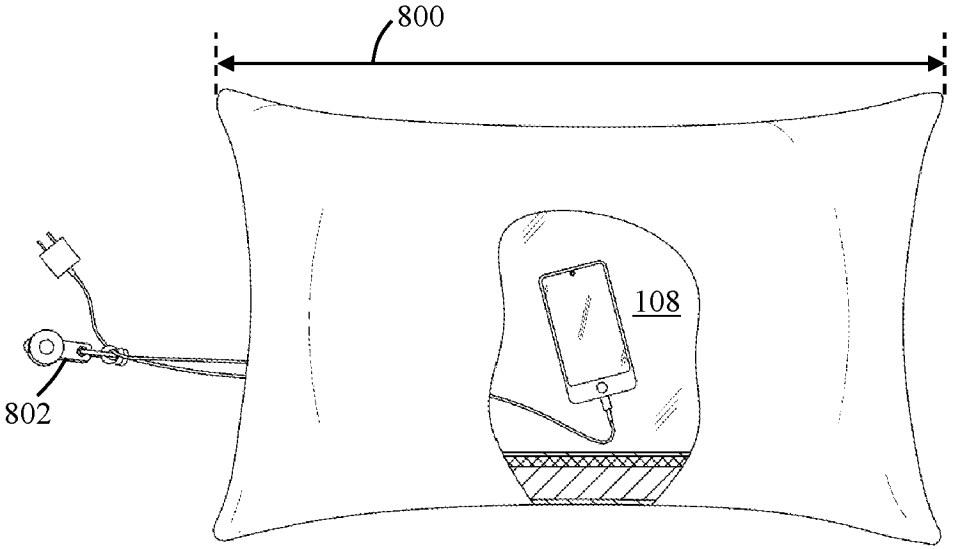
FIG. 8 depicts a partial cross-sectional front view of the pillow assembly with internal storage compartment, in accordance with the present invention.

In accordance with another embodiment of the present invention, as best shown in FIG. 2 and FIG. 8, the pillow body 102 includes a clip 802 coupled thereto and may include two clip members operably configured to selectively open and close, thereby retaining a cable thereto (e.g., a charging cable). The clip members may utilize a spring or other mechanism to apply selective compressive force to the cable. In one embodiment, the clip 802 may be coupled to a tether that may be selectively retracted and extended from the pillow body 102 (as shown in FIG. 8).

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A pillow with internal shielding storage compartment comprising:

a pillow body:

defining an internal cavity;

with an outer cushion layer of a deformably resilient material flanking the internal cavity, having a left end, having a right end opposing the left end, having an upper end, having a lower end opposing the upper end, having an outer surface continuously spanning around the pillow body, and having a pillow length separating the left and right ends;

with an inner layer:

coupled to the outer cushion layer and enclosing the internal cavity;

of a substantially rigid and flexible material configured to enable the inner layer to be placed in a dynamically flexed position to flex with a 10 lb external force applied onto the outer cushion layer without laying completely flat to close the internal cavity and placed in a static unflexed position that is the inherent position of the inner layer without the external force onto the cushion layer and that defines a diameter of the internal cavity greater than the diameter of the internal cavity when in the dynamically flexed position;

of a material more rigid than the deformably resilient material of the outer cushion layer and substantially spanning the pillow length;

of a thickness less than 25 mm;

made with at least one of a metallic material and a polymeric material; and configured to attenuate radio frequencies ranging up to 3 Ghz; and defining an opening disposed proximal to the left end that is spatially coupled to the internal cavity, the opening operably configured to have a selectively opened position and a selectively closed position with at least one fastener coupled to the pillow body, wherein the inner layer is encapsulated by the outer cushion layer when the opening is in the selectively closed position.

2. The pillow with internal shielding storage compartment according to claim 1, wherein the outer surface of the outer cushion layer is of a fabric material.

3. The pillow with internal shielding storage compartment according to claim 1, wherein the outer cushion layer is of a foam material.

4. The pillow with internal shielding storage compartment according to claim 1, wherein the outer cushion layer and the inner layer are adhesively coupled to one another.

5. The pillow with internal shielding storage compartment according to claim 1, wherein the inner layer further comprises:

the static unflexed position with the internal cavity of the diameter ranging from 50-152 mm; and the dynamically flexed position with the internal cavity of a diameter approximately 50% less than the diameter of the internal cavity in the static unflexed position.

6. The pillow with internal shielding storage compartment according to claim 1, wherein the inner layer spans at least 75% of the pillow length.

7. The pillow with internal shielding storage compartment according to claim 1, wherein the pillow body further comprises:

two zipper tracks each flanking the opening and with the at least one fastener coupled to one of the two zipper tracks, the two zipper tracks and the at least one fastener operably configured to place the opening in the selectively closed position.

8. The pillow with internal shielding storage compartment according to claim 1, wherein the pillow body further comprises:

a clip coupled to the pillow body and with two clip members operably configured to selectively open and close, thereby retaining a cable thereto.

9. The pillow with internal shielding storage compartment according to claim 1, wherein the thickness of the inner layer unitarily spans the pillow length.

10. The pillow with internal shielding storage compartment according to claim 1, wherein the inner layer is coated with a metallic material.

11. A pillow with internal shielding storage compartment comprising:

a pillow body:

defining an internal cavity;

with an outer cushion layer of a deformably resilient material flanking the internal cavity, having a left end, having a right end opposing the left end, having an upper end, having a lower end opposing the upperend, having an outer surface continuously spanning around the pillow body, and having a pillow length separating the left and right ends;

with an inner layer:

coupled to the outer cushion layer and enclosing the internal cavity;

of a substantially rigid and flexible material that is more rigid than the deformably resilient material of the outer cushion layer and that substantially spans the pillow length;

of a substantially rigid and flexible material configured to enable the inner layer to be placed in a dynamically flexed position to flex with a 10 lb external force applied onto the outer cushion layer without laying completely flat to close the internal cavity and placed in a static unflexed position that is the inherent position of the inner layer without the external force onto the cushion layer and that defines a diameter of the internal cavity greater than the diameter of the internal cavity when in the dynamically flexed position;

made with at least of a metallic material and a polymeric matrial; and of a slender thickness substantially spanning the pillow body; and defining an opening disposed proximal to the left end that is spatially coupled to the internal cavity, the opening operably configured to have a selectively opened position and a selectively closed position with at least one fastener coupled to the pillow body, wherein the inner layer is encapsulated by the outer cushion layer when the opening is in the selectively closed position.

12. The pillow with internal shielding storage compartment according to claim 11, wherein the inner layer is of a thickness less than 25 mm.

13. The pillow with internal shielding storage compartment according to claim 11, wherein the inner layer further comprises:

the static unflexed position with the internal cavity of a diameter ranging from 50-152 mm; and the dynamically flexed position with the internal cavity of a diameter approximately 50% less than the diameter of the internal cavity in the static unflexed position.

14. The pillow with internal shielding storage compartment according to claim 11, wherein the inner layer is configured to attenuate radio frequencies ranging up to 3 Ghz.

15. The pillow with internal shielding storage compartment according to claim 14, wherein the inner layer is of metallic material.

16. The pillow with internal shielding storage compartment according to claim 11, wherein the inner layer is coated with a metallic material.

* * * * *